US010711581B2

(12) United States Patent
Ning et al.

(10) Patent No.: US 10,711,581 B2
(45) Date of Patent: Jul. 14, 2020

(54) INJECTION FLOW CONTROL DEVICE AND METHOD

(71) Applicants: Jing Ning, Spring, TX (US); David A. Howell, Houston, TX (US); Scott R. Buechler, Spring, TX (US)

(72) Inventors: Jing Ning, Spring, TX (US); David A. Howell, Houston, TX (US); Scott R. Buechler, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 82 days.

(21) Appl. No.: 15/592,696

(22) Filed: May 11, 2017

(65) Prior Publication Data

US 2018/0030812 A1 Feb. 1, 2018

Related U.S. Application Data

(60) Provisional application No. 62/367,892, filed on Jul. 28, 2016.

(51) Int. Cl.
*E21B 43/12* (2006.01)
*E21B 43/16* (2006.01)
(Continued)

(52) U.S. Cl.
CPC ..... *E21B 43/12* (2013.01); *E21B 43/14* (2013.01); *E21B 43/16* (2013.01); *E21B 2034/005* (2013.01)

(58) Field of Classification Search
CPC ..... E21B 43/12; E21B 43/14; E21B 43/16; E21B 2034/005; E21B 43/162; E21B 43/166
See application file for complete search history.

(56) References Cited

U.S. PATENT DOCUMENTS 2,241,656 A * 5/1941 Crickmer ..... E21B 43/123 417/115
4,617,999 A * 10/1986 Beck ..... E21B 34/108 166/321

(Continued)

OTHER PUBLICATIONS

Schlumberger, "*New ICD Design Eliminates Need for Washpipe, Trims 24 Hours from North Sea Project, and Saves USD* 800,000,"2015 Schlumberger, slb.com/sandcontrol.

(Continued)

*Primary Examiner* — Tara E Schimpf
*Assistant Examiner* — Manuel C Portocarrero
(74) *Attorney, Agent, or Firm* — ExxonMobil Upstream Research Company—Law Department

(57) ABSTRACT

In a well related to the production of hydrocarbons, an injection apparatus including: a base pipe including a radial port; an in-flow control device including a flow restriction device and a housing, with the housing being external and concentric of the base pipe. The housing includes a closed end portion and an open, opposite end portion and a housing channel communicating the opposite end portion. The flow restriction device is disposed at an intermediate location along the housing channel and adapted to control a rate of flow along the housing channel. A fluid transmissive screen is concentric of the base pipe and extends from the open, opposite end portion of the housing. A check valve assembly is interposed between the opposite end portion of the housing and a screened space.

31 Claims, 6 Drawing Sheets

(51) Int. Cl.

| | |
|---|---|
| ***E21B 43/14*** | (2006.01) |
| ***E21B 34/00*** | (2006.01) |
| ***E21B 49/08*** | (2006.01) |
| ***E21B 49/00*** | (2006.01) |
| ***E21B 43/25*** | (2006.01) |
| ***E21B 43/24*** | (2006.01) |

(56) References Cited

U.S. PATENT DOCUMENTS

| | | | | |
|---|---|---|---|---|
| 7,708,068 | B2 * | 5/2010 | Hailey, Jr. ..... | E21B 43/08<br>166/278 |
| 2009/0151925 | A1 * | 6/2009 | Richards ..... | E21B 34/06<br>166/53 |
| 2013/0081824 | A1 * | 4/2013 | Hill, Jr. ..... | E21B 34/102<br>166/375 |
| 2015/0000927 | A1 | 1/2015 | Madell | |

OTHER PUBLICATIONS

Schlumberger, "*ResFlow*,"2015 Schlumberger, slb.com/resflow, 4 pp.

Torbergsen, Hans-Emil B., "*Application and Design of Passive Inflow Control Devices on the Eni Goliat Oil Producer Wells*," University of Stavanger, Master's Thesis, 2010, 557 pp.

* cited by examiner

INJECTION FLOW CONTROL DEVICE AND METHOD

CROSS REFERENCE TO RELATED APPLICATION

This application claims the benefit of U.S. Provisional Application Ser. No. 62/367,892 filed Jul. 28, 2016, entitled, "Injection Flow Control Device and Method," the disclosure of which is incorporated herein by reference in its entirety.

FIELD

The present disclosure relates generally to apparatus and methods of optimizing injection along a well bore and more particularly, to apparatus and methods of optimizing injection in an unconsolidated reservoir.

BACKGROUND

As an illustrative example, it may be desirable to perform injection on one or more wells to stimulate production from a subterranean formation, in particular, a hydrocarbon-bearing reservoir, to increase potential production therefrom. These injection operations may include providing an injection fluid to specific, or target, regions of the subterranean formation and may utilize stimulation ports within a casing string to provide the injection fluid from the casing conduit to the target region of the subterranean formation.

A major concern to well operators is injection failure in unconsolidated reservoirs, especially unsustained and reduced injectivity due to water quality and fines production. Constant injection of fluids having a high concentration of solids at a high flux rate over years may erode portions of the injector screens. Erosion from inside out may cause screen failure and expose tubing to formation during a backflow or a cross flow. Fines (sands) that are carried by formation fluids during a crossflow or a backflow event may fill tubing and cause a loss of injectivity, especially amongst co-mingled injectors targeting unconsolidated reservoirs. Additionally, occurrence of a water hammer event or a pressure surge within the string, such as during a shut-in, may exacerbate the risk of a sand failure.

There exists a need for injection methods and apparatus that are counteractive to the deleterious effect of backflows, crossflows and internal pressure surges on the service life of injection systems so as to prolong their useful service life.

Despite recent advances, there remains an unmet need in the art to optimize design of well-bore injection systems such that ingestion of formation fluids into the injector string due to flow reversals is abated, if not wholly avoided.

SUMMARY

The present disclosure teaches how to address the aforementioned issues by integrating a flapper type check valve downstream of an in-flow control device (ICD) housing to promote injection optimization. The Optimal-Inject Check-Valve ICD comprises an in-flow control device which automatically closes an axial tubing in a check valve component when the injection flow suffers a reversal and which maintains flow conformance control during injection in the same manner as the ICD. The one-way check valve blocks fluid passage during crossflows and backflows, and may provide a back-up assurance (redundancy) to the flow restriction of the ICD. The arrangement effectively blocks fines production in the tubing and prevents injection performance degradation over the long term, where frequent shut-ins and cross flow due to pressure differentials amongst different sands are inevitable.

In an embodiment, there is provided a wellbore injection apparatus resistive to perturbations in fluid flows comprising: a base pipe including a radial port at a location along the base pipe; an in-flow control device comprising a flow restriction device and a housing, with the housing being external and concentric of the base pipe and comprising: a closed end portion adjacent the radial port, an open, opposite end portion distal from the port and a housing channel communicating the radial port with the opposite end portion, with the flow restriction device being disposed at an intermediate location along the housing channel and adapted to control a rate of flow along the housing channel; a fluid transmissive screen concentric of the base pipe and extending from the open, opposite end portion of the housing, the screen and adjacent portions of the base pipe at least partially defining a screened space; a check valve assembly interposed between the open, opposite end portion of the housing and the screened space, with the check valve assembly being operative to allow fluid to flow in a first axial direction from the port, through the housing channel and into the screened space and to close fluid flow responsive to perturbations in fluid flow tending to redirect fluid flow in a direction opposite of the first direction.

Preferably, the check valve assembly is biased to close responsively to a reversal of fluid flow in the screened space and/or a reversal of flow in the housing channel and/or the check valve assembly is biased to close responsively to a reversal of fluid flow in the screened space due to a back flow or a cross flow adjacent the screen and/or the check valve assembly is biased to close responsively to a reversal of fluid flow due to a water hammer event or a pressure surge.

In an embodiment, the check valve assembly comprises a flapper valve which may comprise a biased flap body and an annular seat. Alternatively, the check valve assembly may comprise an annular valve comprising an annular seat concentric of the back pipe and a moveable annulus.

In an embodiment, the flow restriction device is sized to impart a predetermined flow rate along the housing channel and the check valve assembly is configured to impart approximately the same predetermined flow rate.

The radial port of the base pipe may be sized to permit a greater fluid flow than the flow restriction device and the check valve assembly.

In another embodiment, the check valve assembly comprises a first ring provided with a check valve and second ring provided with a flow-controlling, axially directed passage sized to impart approximately the same predetermined flow rate as the flow restriction device.

In yet another embodiment, the flow restriction device and the check valve assembly comprise first and second axially directed flow passages, respectively, and the first and second axially directed flow passages may be circumferentially offset from one another.

The disclosure also provides a method of extending a useful life of a well bore apparatus comprising an in-flow control device and a screen, the method comprising: interposing a check valve assembly between the in-flow control device and the screen; and operating the check valve assembly to allow fluid to flow in a first axial direction relative to the screen and the in-flow control device and to close fluid flow responsive to perturbations in fluid flow tending to redirect fluid flow in a direction opposite of the first direction; and limiting flow rate to the screen redundantly with both the check valve assembly and a flow restriction device of the in-flow control device. The operating portion of the method may include biasing the check valve assembly to close responsively to a reversal of fluid flow from a flow perturbation occurring adjacent the screen and/or adjacent the in-flow control device, and may include biasing the check valve assembly to close responsively to a reversal of fluid flow in the screened space due to a back flow or a cross flow adjacent the screen. Also, it may include biasing the check valve assembly to close responsively to a reversal of fluid flow adjacent the in-flow control device due to a flow perturbation comprising a water hammer event or a pressure surge.

In an embodiment, the limiting flow portion of the method may include sizing the flow restriction device to impart a predetermined flow rate along the in-flow control device and configuring the check valve assembly to impart approximately the same predetermined flow rate.

In an embodiment, the method further comprises communicating fluid from a base pipe into the in-flow control device through a port sized to permit a greater fluid flow than the flow restriction device and the check valve assembly.

In yet another embodiment, the flow restriction device and the check valve assembly comprise first and second axially directed flow passages, respectively, and the first and second axially directed flow passages are circumferentially offset from each other.

The disclosure also provides a method of injecting into a well bore comprising: discharging fluid from an in-flow control device through a screen while interposing a check valve assembly between the in-flow control device and the screen; and operating the check valve assembly to allow fluid to flow in a first axial direction to the screen through the in-flow control device and to close fluid flow responsive to perturbations in fluid flow tending to redirect fluid flow in a direction opposite of the first axial direction. In an embodiment, the method further comprises limiting flow rate to the screen redundantly with both the check valve assembly and a flow restriction device of the in-flow control device.

In addition, the disclosure provides a system for producing hydrocarbons comprising: a base pipe including a radial port at a location along the base pipe; an in-flow control device comprising a restriction device and a housing, the housing external and concentric of the base pipe, wherein the housing comprises a closed end portion adjacent the radial port, an open, opposite end portion distal from the port and a housing channel communicating the radial port with the opposite end portion, and wherein the flow restriction device disposed at an intermediate location along the housing channel and adapted to control a rate of flow along the housing channel; a fluid transmissive screen concentric of the base pipe and extending from the open, opposite end portion of the housing, the screen and adjacent portions of the base pipe at least partially defining a screened space; and a check valve assembly interposed between the open, opposite end portion of the housing and the screened space, the check valve assembly being operative to allow fluid to flow in a first axial direction from the screened space into the housing channel and to close fluid flow responsive to perturbations in fluid flow tending to redirect fluid flow in a direction opposite of the first axial direction.

The disclosure also provides a method of producing hydrocarbons from a formation of a well comprising: drawing a hydrocarbon-bearing fluid from the formation into a screened space and into an in-flow control device while interposing a check valve assembly between the in-flow control device and the screened space; and operating the check valve assembly to allow fluid to flow in a first axial direction into the in-flow control device from the screened space and to close fluid flow responsive to perturbations in fluid flow tending to redirect fluid flow in a direction opposite of the first axial direction. In an embodiment, the method further comprises limiting flow rate to the screen redundantly with both the check valve assembly and a nozzle of the in-flow control device. 30. In other embodiments, the method further comprises maintaining the check valve away from direct communication with a fluid flow within a base pipe during production and/or protecting the check valve from a fluid flow within a base pipe during production with a nozzle ring.

BRIEF DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
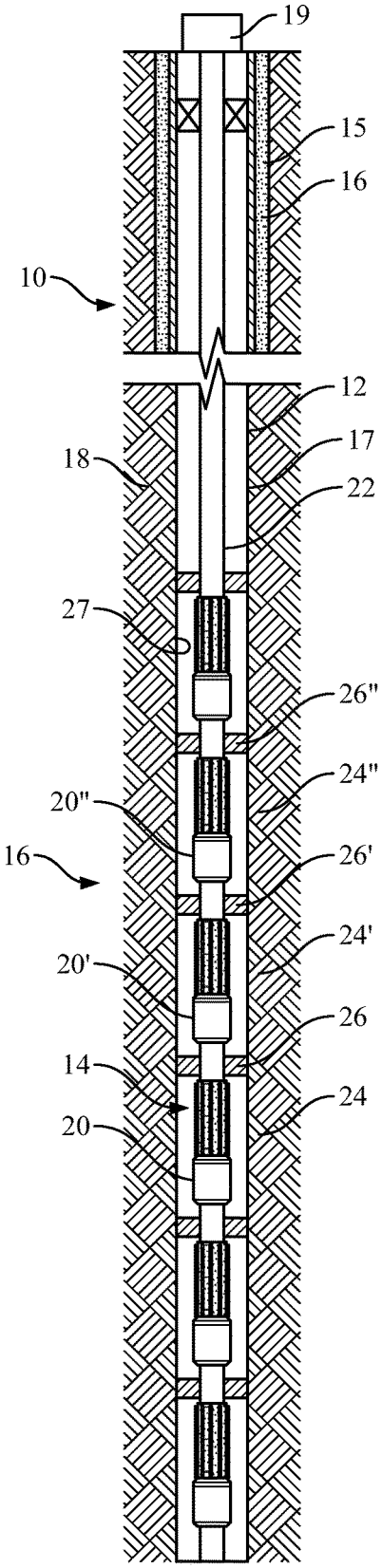
FIG. 1 is a schematic representation of a well system which includes an injection system (string) comprising a plurality of injector joints constructed in accordance to an embodiment of the present disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, blocks may be implemented in logic. In other examples, processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in parallel, and/or at substantially different points in time. In some examples, methods may be implemented as processor executable instructions. Thus, a machine-readable medium may store processor executable instructions that if executed by a machine (e.g., processor) cause the machine to perform a method.

Full-physics: As used herein, the term "full-physics," "full physics computational simulation," or "full physics simulation" refers to a mathematical algorithm based on first principles that impact the pertinent response of the simulated system.

May: Note that the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

Description

Specific forms will now be described further by way of example. While the following examples demonstrate certain forms of the subject matter disclosed herein, they are not to be interpreted as limiting the scope thereof, but rather as contributing to a complete description.

Referring to FIG. 1, this disclosure provides a well system 10 comprising a well-bore 12 and an injection system (string) 14 disposed along an injection interval 16 of a subterranean, hydrocarbon-bearing reservoir 18. In an embodiment, the injection string 14 may comprise a plurality of serially communicated, individual injector assemblies (injector joints) 20, 20' and 20". It is contemplated that the injection string 14 may comprise fewer injector joints 20 or additional injector joints 20 as the case might be in a particular application, mostly depending upon the length of the particular injection interval 16. However, the teachings herein describe aspects of the injector string 14 respective of the three individual injector assemblies (injector joints or injectors) 20, 20' and 20" as a matter of simplification in rendering the description. The injection string 14 may also include other components of functionalities different from those of the injectors 20 such as in-flow control devices (ICD's) for producing oil flow to the wellhead 19, sensors and other components, and the reservoir 18 may include more than one injection interval 16.

In the illustrated embodiment, the wellbore 12 extends downwardly from a wellhead 19 located proximate a surface location, through various subterranean strata and into the hydrocarbon-bearing reservoir 18. The wellbore 12 may include an upper vertical portion 15 having a casing string 16 that may be cemented within wellbore 12 and a lower vertical section 17 that extends through the hydrocarbon bearing subterranean formation (reservoir) 18. As illustrated, the lower section 17 of the wellbore 12 may be open hole and may have a vertical or inclined orientation. The lower section 17 of wellbore 12 may also include a horizontal section and may comprise a combination of vertical, inclined and/or horizontal sections. A production control assembly may be associated with a wellhead 19 which may be adapted or configured to control a supply of stimulant fluids from the wellhead 19 to the reservoir 18 via the injection string 14 and/or the production of reservoir fluid from the reservoir 18 to the wellhead 19.

Regarding the objection to "reference characters "30*a*" and "30*b*" in [0061], lines 2-3 have both been used to designate "exterior portion," Applicants respectfully traverse. The specification in [0061] expressly states that "30*a*" is a first exterior portion, and "30*b*" is a second exterior portion. These are distinct references and properly refer to distinct, different locations along the exterior surface of base pipe 30. Applicants respectfully analogize that the numbering is analogous to distinguishing elements using reference characters referring to an upper end of something and a lower end of something. Most respectfully, Applicants do not understand the basis for this objection. If the Examiner determines to maintain the objection, Applicants are happy to amend as needed, but most humbly request a more detailed explanation for why this numbering convention and component identification is objectionable so the proper corrections may be undertaken.

In an embodiment, the well system 10 includes a tubular string portion 22 which extends through the upper portion 15 of the well-bore 12 from the wellhead 19 to the injector sting 14 to communicate to the injection string 14 a flow of injection fluids introduced at the wellhead 19. Each of the injectors (injector joints) 20 discharge into a local, treatment zone 24 of the injection interval 16 adjacent each injector joint 20 such that the injector joints 20, 20', 20" of the exemplary embodiment are operative to inject fluids into a plurality of treatment zones 24, 24', 24", respectively.

In an exemplary embodiment, the injector string 14 further comprises a plurality of packers 26 which may be disposed between the injection string 14 and an inner surface 27 of the wellbore 12 at spaced locations along the injection string 14. The packers 26 isolate operation of the injectors 20 from one another (or groups of injectors 20 from one another) and impede fluid communication between the plurality of treatment zones 24. Accordingly, in the exemplary embodiment, a plurality of packers 26, 26', 26" isolate injectors 20, 20', 20" from one another and impede fluid communication between the plurality of treatment zones 24, 24', 24". In an embodiment, the spacing between the packers 26, 26', 26" may generally correspond with the unit length of an injectors 20 such that a single injector 20 is operative upon a single treatment zone 24. However in other embodiments, two or more injectors 20 may be enclosed by a pair of adjacent packers 26 such that the two or more injectors are operative upon a larger treatment zone 24 than in the exemplary embodiment. In other embodiments, the spacing between packers 26 may vary such that the extents of the respective treatment zones 24 vary accordingly.

Generally, in an injection application, fluid is injected into an injection interval 16 of the well 10 at one or more treatment zones 24 as described above. For example, waterflooding is an injection practice that may be used to increase recovery of oil from the reservoir 18. Water is injected into the reservoir 18 through an injection well 10 as a nearby producing well produces oil from the formation. The goal is to maintain reservoir pressure and to generate a sweeping effect which pushes the oil using the injected water. One problem often encountered in injection applications occurs when injected fluid flows back into the well or when crossflow occurs. Another problem occurs when an inline valve or a pump is shut suddenly. When this happens, an over pressure wave is generated creating a water hammer. This wave, or water hammer, propagates downhole and "liquefies" poorly consolidated sand of the formation. Each of these problems can create a sanding issue in which sand enters the well, progressively plugging the well and requiring expensive cleaning operations. Heretofore, this problem has been addressed with standard sand control methods, such as sand screens, gravel packs, and expandable sand screens.

Figure 2A:
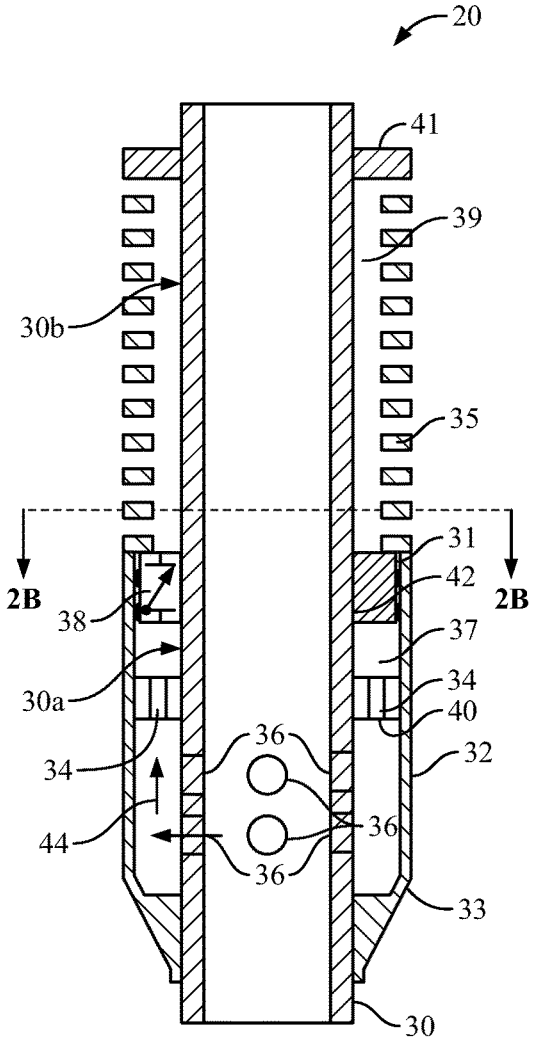
FIG. 2*a* is a schematic representation in cross-section of an individual injector joint of the injection system according to the embodiment shown in FIG. 1.

Referring now also to FIGS. 2 and 3, in an embodiment each injector joint 20 comprises a base pipe 30, a housing body 32 disposed about a first exterior portion 30*a* of the base pipe 30, a screen 35 disposed about a second exterior portion 30*b* of the base pipe 30, a flow restriction device 34 at an intermediate location within the housing body 32 and a check valve 38 at an end portion 31 of the housing body 32 adjacent the screen 35. The term "flow restriction device" means any flow restricting, controlling, regulating, throttling, directing, enhancing, mixing, device or feature affecting fluid flow, including but not limited to a nozzle, orifice plate, orifice, venturi, critical flow device, or the like.

The base pipe 30 is provided with a plurality of radially directed ports 36 which communicate fluid flow from within the base pipe 30 to a closed end portion 33 of the housing body 32. Accordingly, the housing body 32 may comprise a closed end portion 33 adjacent the radial ports 36 of the base pipe 30 and an open end portion 31 distal from the ports 36, thereby defining a housing channel 37 communicating the radial ports 36 with the opposite end portion 31 of the housing body 32.

The flow restriction device 34 is adapted to control the rate of flow along the housing channel 37 in a manner of what is known to the industry as an inflow control device (ICD). In the context of the exemplary embodiment, the size or the number of the orifices 34' of the nozzle 34 are determined by the desired rate of injection flow for a given treatment region 24 and the tendency of an orifice closer to a source of pressurized fluid (at the wellhead 19) to short circuit those which are connected in series further from the source. Accordingly, if an equal injection rate along the injection string 14 is desired, the latter consideration would tend to require smaller nozzle orifices 34' in the injector joints 20 closer to the wellhead 19 and larger ones in the injector joints 20 further from the wellhead 19.

Figure 2B:
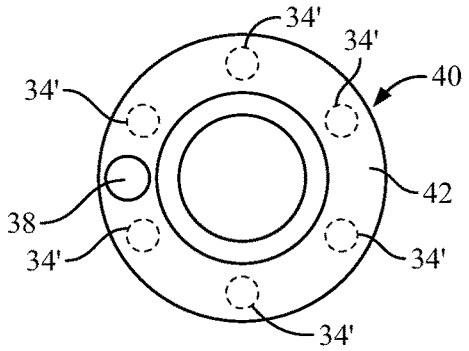
FIG. 2*b* is a schematic detail view of ring structure within an embodiment of an individual injector joint, the view being in the direction of the double arrow B-B in FIG. 2*a;*

Referring now to FIG. 2*b*, the nozzle 34 may comprise a plurality of nozzle orifices 34' provided in a nozzle ring 40. The number and size of the nozzle orifices 34' may vary from what is shown in FIG. 2*b* depending upon factors such as the desired flow rate through the injector joint 20. In this embodiment, the check valve 38 comprises a single check valve 38 which may be supported on ring 42, and the check valve 38 may be offset from (out of axial alignment with) any of the orifices 34' comprising the nozzle 34. Utilizing a single check valve 38 avoids multiplicity, promotes simplicity and minimizes risk of equipment failure. The teachings herein include embodiments wherein two or more check valves 38 are employed, such the exemplary embodiment shown in FIG. 4.

Figure 3A:
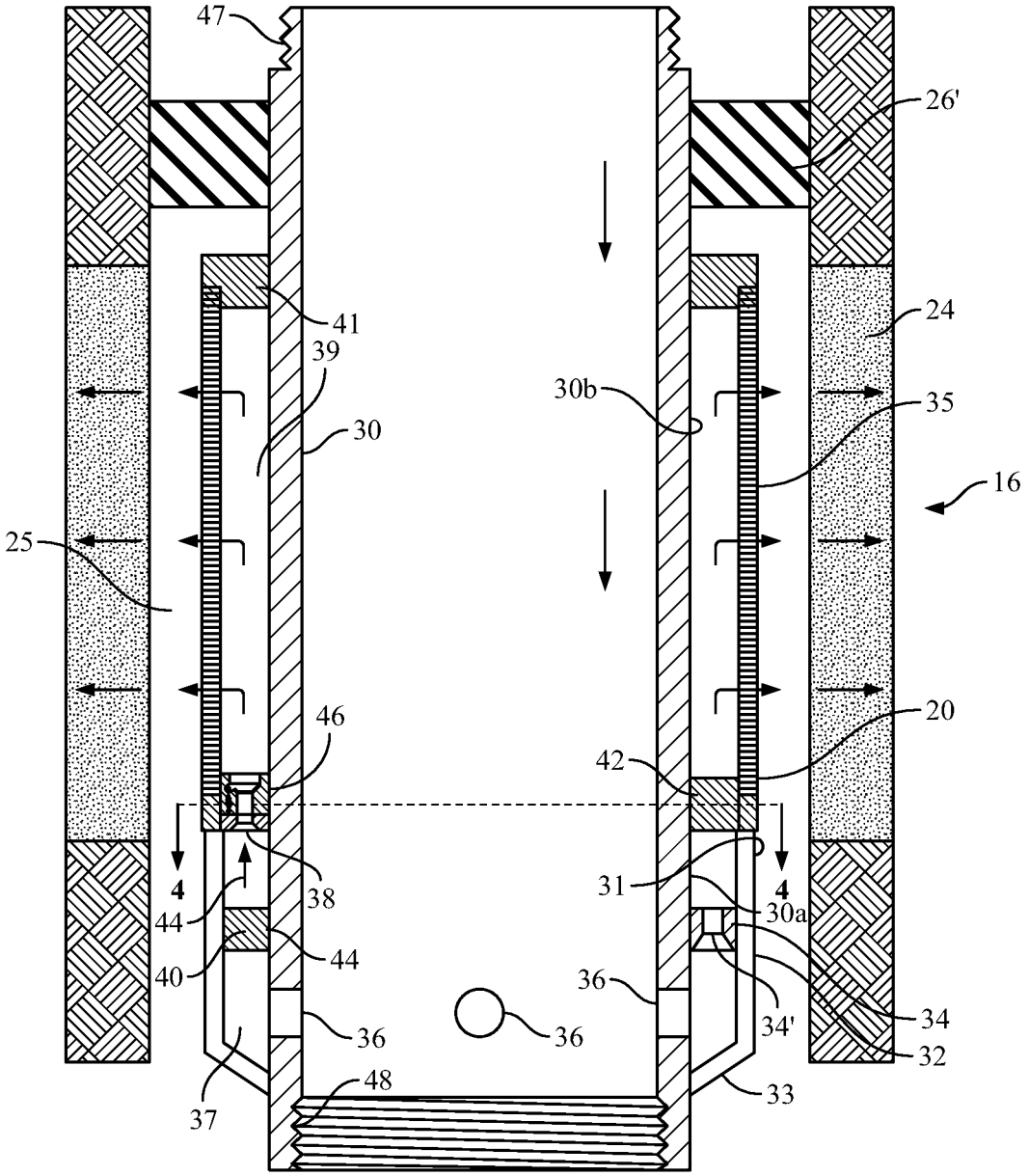
FIG. 3*a* is a schematic representation in cross-section of an individual injector assembly of the injection system according to another embodiment of the present disclosure, wherein check valves and the nozzles are off-set from one another.

Referring to FIG. 3*a*, the fluid transmissive screen 35 is preferably disposed concentrically of the base pipe and extends from and communicates with the open end portion 31 of the housing body 32 via (through) the check valve 38. The screen 35 and the adjacent (opposing) portion 30*b* of the base pipe 30 and a closure ring 41 may at least partially define a screen space 39. During an on-going injection operation, a flow of injection fluid passes axially through the housing channel 37, the nozzle 34 and the check valve 38 before entering the screen space 39. Thereupon, the fluid is discharged through the screen 35 into the annular space 25 surrounding the screen 35 and into the local treatment region 24.

The check valve assembly 38 is preferably interposed between the open end portion 31 of the housing and screened space 39. The check valve assembly 38 is operative to allow fluid to flow in a first axial direction from the ports 36 through the housing channel 37 and into the screen space 39 and to close fluid flow responsively to perturbations in flow tending to redirect fluid flow in a direction opposite of the first direction. The aforementioned first axial direction is in the sense of being parallel to the longitudinal axis of the base pipe 30 and is also represented by the arrow 44 in FIG. 3*a* and FIG. 2*a*.

Figure 4:
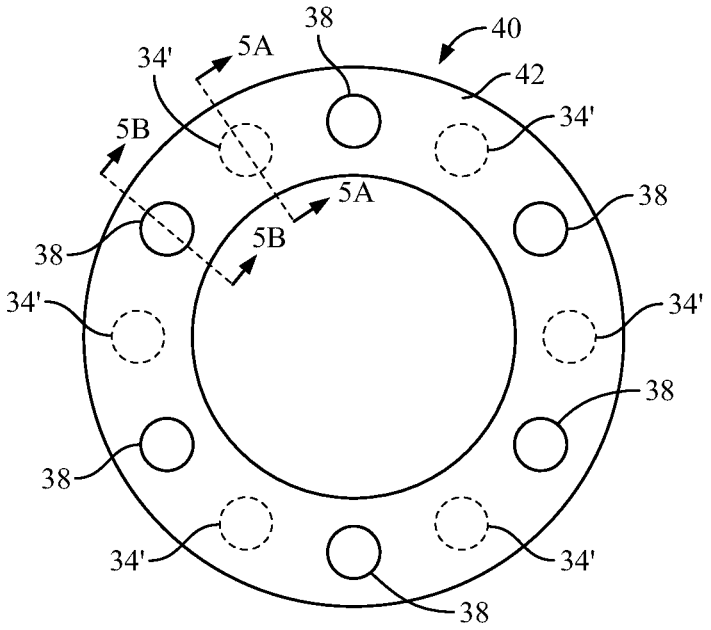
FIG. 4 is a schematic representation of an axial view of the embodiment shown in FIG. 3*a* in the direction of the double arrow 4-4 therein.

Referring now to FIGS. 3*a* and 4, in an embodiment, the nozzle 34 may comprise a plurality of axially directed nozzle orifices 34' at circumferentially spaced locations about a nozzle ring 40. Optionally, the nozzle 34 may include nozzle inserts such as those described in US Published Patent Application No. 2015/0000927. In embodiments, the ring 40 may be disposed at an intermediate location along the housing body 32 between the base pipe 30 and the housing body 32 and may be fixed by a threaded connection, pin, a weld, braze or other convenience 44. Likewise, the check valve 38 may comprise a single or a plurality of axially directed check valves 38, the latter being at circumferentially spaced locations about a check-valve ring 42. In embodiments, the ring 42 may be connected at the open end portion 31 the housing body 32 between the base pipe 30 and the housing body 32 by a threaded connection, pin, a weld, braze or other convenience 46.

Referring particularly to FIG. 3*a*, each injector joint 20 may further comprise threaded end portions 47, 48 of the base pipe 30 for serially joining individual injector joints 20 to one another. Prior to such joinder, the desired orifice sizes of the nozzle 34 and the check valve 38 would be selected so as to achieve the desired flow for the particular injector 20. In embodiments, the ports 36 of the base pipe 30 are sized larger than the largest of the nozzles 34 so that the ports 36 are not normally determinative of the rate of flow through the housing channel 37. Accordingly, the ports 36 of the base pipe 30 need not differ from one section of the base pipe 30 to the next. Joinder of the injector joints 20 may be effected with other arrangements such as clasps, welds, brazes, snap fits or the like.

Figure 3B:
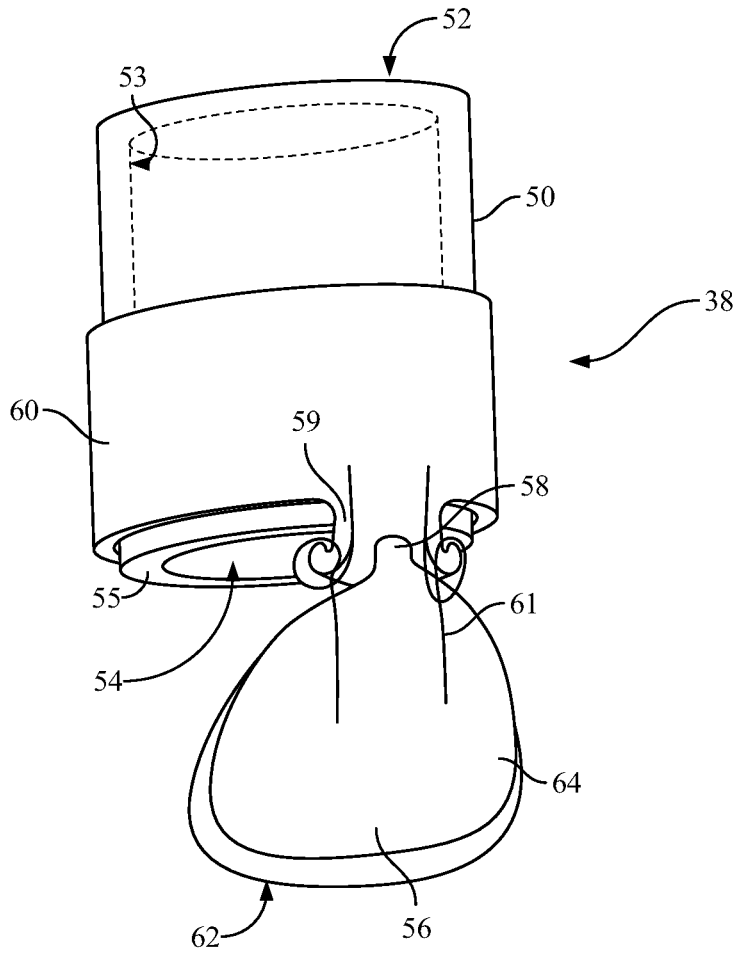
FIG. 3*b* is perspective view of an exemplary flapper check-valve of the individual injector assembly shown in FIG. 3*a;*

Referring now to FIG. 3*b*, in embodiments, the check valve 38 comprises one or more axially directed flapper valves 38 comprising a tubular body 50 having an inlet 52, a channel 53, an outlet 54 and a valve seat 55. The check valve 38 may further comprise a flap body 56 that is rotatable about a hinge connection 58 between a flange of the flap body 56 and a flange 59 of a mounting fixture 60. A coil spring or a torsion element or other convenience 61 is provided to bias the flap body 56 toward a closed position where the underside 62 of the flap body 56 seats against the valve seat 55. In operation, injection fluid entering the channel 53 of the check valve 38 causes the flap body 56 to move away from the valve seat 55 to an opened position, whereupon injection fluid flows from the housing channel 37 into the screen space 39. Any reversal of flow urges the flap body 56 to return to its closed position against the seat 55. As a result, the flow reversal is checked by closure of the valve 38.

In an embodiment, a single check valve 38 may be provided in a ring 40 or in other embodiments two or more, preferably two, four, six or eight check valves 38 are provided in a ring 40 at the distal end portion 31 of the housing body 34. In any case, the size (internal diameter) of the internal channel 53 of the check valve(s) 38 may be selected to be greater than the size (internal diameter) of the nozzle 34 so that the nozzle size of the nozzle 34 is determinative of the flow rate through the housing channel 37. In other embodiments, the size of the internal channel(s) 53 of the check valve 38 are selected to be of a size equivalent to that of the nozzle 34 so that the check valve(s) 38 provides a redundant backup capability of flow control should the nozzle 34 suffer wear or otherwise lose its capacity to control flow adequately. The redundancy may contribute extended downhole service life of the injector 20 over those without the redundancy.

Figure 5A:
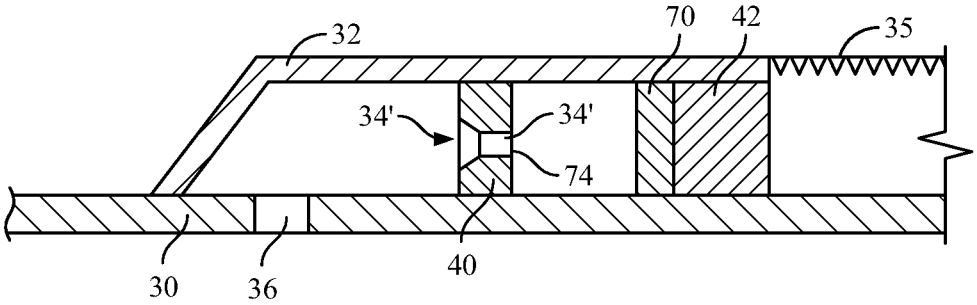
FIG. 5*a* is a schematic detail in cross-section of a portion of the injector assembly taken in the direction of the double arrow 5A-5A in FIG. 4.
Figure 5B:
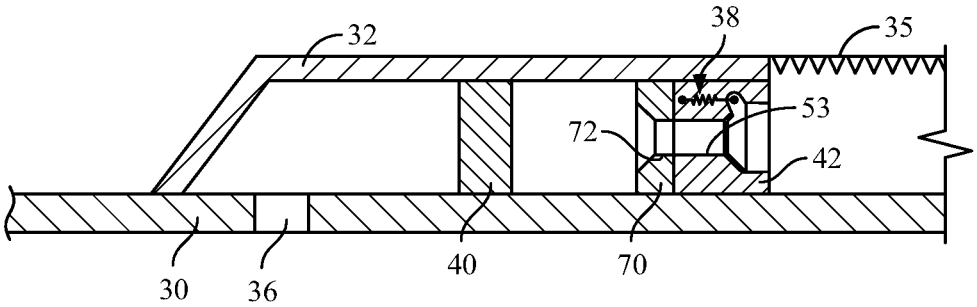
FIG. 5*b* is a schematic detail in cross-section of a portion of the injector assembly taken in the direction of the double arrow 5B-5B in FIG. 4.

Referring to FIG. 5*b*, in yet another embodiment, the check valve 38 may be standardized by providing it with a supplementary ring element 70 having an orifice 72 of equal effective flow-area size to that of the orifice(s) 34' of the nozzle 34 in a given injector joint 20. With the ring 70 providing the desired redundancy in flow control, the internal channel 53 of the check valve 38 may be provided a standard effective flow size, preferably a size larger than that of any of the nozzle 34 amongst the injectors joints 20 in the injection string 14. In an embodiment, the ring element 70 of the check valve assembly 38 may be a duplicate of the ring 40 of the nozzle 34, which simplifies and facilitates construction of the injector string 14.

Referring now to FIGS. 4, 5*a* and 5*b*, in an embodiment, the rings 40 and 42 are positioned such that the nozzle orifices 34' and the check valves 38 are circumferentially offset from one another so that discharge of fluid from one does not impact, erode or scour the other, thereby prolonging the service life of the injector 20 and that of the injection string 14.

The check valve 38 may comprise other types of valves. In an embodiment, the check valve assembly 38 may comprise an annular valve comprising an annular seat concentric of the back pipe and a moveable annulus. In another embodiment, the check valve 38 may comprises a seated ball type of check valve. Also, it is envisioned that the positions of the check valve 38 and the nozzles 34 along the housing channel 37 could be reversed.

Figure 6:
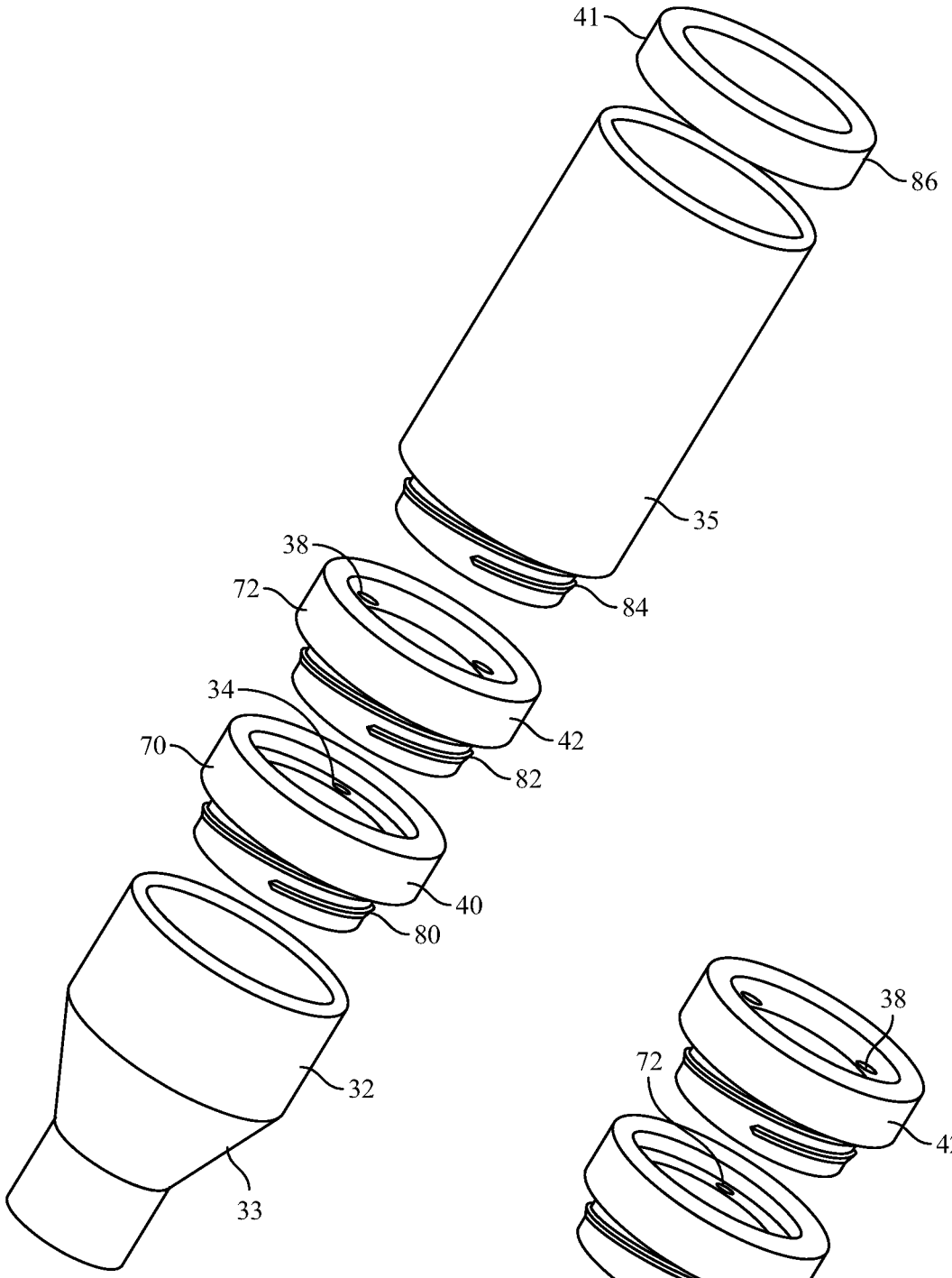
FIG. 6 is an exploded view of the various components that may comprise an embodiment constructed in accordance with the present disclosure.

Referring now to FIG. 6, in an embodiment, the injector 20 comprises a housing body 32, a ring 40 in which resides the nozzle 34, a ring 42 in which resides the check valve 38 and a screen 35, together with a closure ring 41, substantially as previously described, which may be joined together with one or more threaded connections 80, 82, 84 and 86. In embodiments, the one or more connections 80, 82, 84 and 86 may be instead, in lieu, or in addition comprise a snap-connection, a pinned connection, a weld, or a brazed connection. In any case, an outer annular portion 70 of the ring 40 and an outer annular portion 72 of the ring 42 may in effect become removable portions of the housing body 32 and upon connection internally define portions of the housing channel 37.

As noted previously with reference to FIG. 3*a*, the rings 40 and 42 may instead be fitted between the base pipe 30 and the housing body 32 and secured by a force fit, brazing, a weld or threading.

The housing body 32 may be affixed to a section of the back pipe 30 either by welding, brazing and/or a threaded connections at the closed end portion 33 of the housing body 32 and at the closure ring 41.

Figure 7:
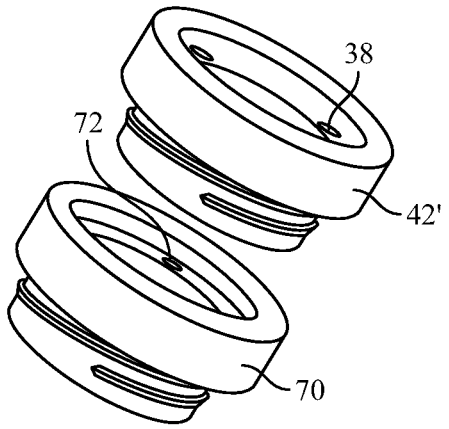
FIG. 7 is an exploded view of an alternate construction of the check valve component of the embodiment shown in FIG. 6.

Referring now to both FIGS. 6 and 7, in an embodiment, the ring 42 of FIG. 6 may instead comprise a pair of rings 42' and 70 as discussed above with respect to the embodiment shown in FIG. 5*b*.

Figure 8:
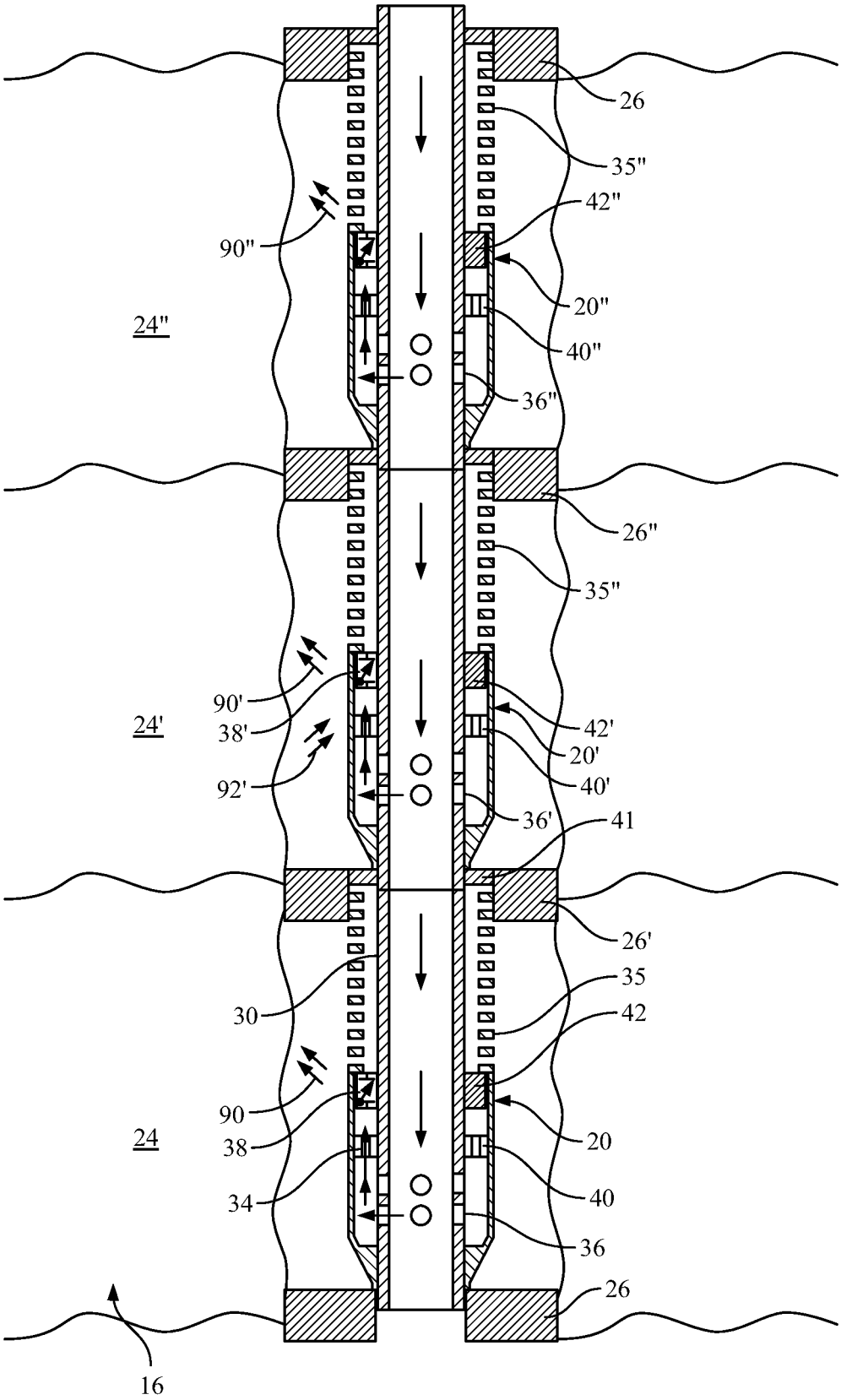
FIG. 8 is a schematic representation in cross section of a down hole portion of a well system constructed in accordance to an embodiment of the present disclosure.

An illustration of the operating principles of the embodiments is now provided in reference to FIG. 8, wherein an exemplary string 14 of injectors 20, 20', 20" are hypothetically injecting fluid into adjacent treatment regions 24, 24', 24" in accordance with the foregoing teachings. Discharge of the fluid from the screens 35, 35', 35" into the adjacent treatment regions 24, 24', 24" during normal operations is represented by the double arrows 90, 90', 90". At some point during the hypothetical operation of the well 10, a flow perturbation occurs within treatment interval 16 and/or in the reservoir 18 such that the fluid flow in the intermediate treatment region 24' reverses, which reversal is represented by the double arrow 92'. The reversed flow 92' may comprise a flow of sand-bearing formation fluids and may be the result of a buildup of local pressures or other conditions within the formation that precipitate a backflow or a crossflow at the local treatment region 24'. Upon occurrence of the flow reversal 92', the check valve 38' closes, thereby limiting, if not wholly preventing entry of the formation fluids into the screen space 39', the housing body 32' of the injector 20' and the rest of the injector string 14. Once closed, the check valve 38' will continue to protect service life of the injection string 14 by remaining closed and preventing formation fluids from entering the system. Upon a favorable recovery of fluid conditions within the intermediate local treatment region 24', the check valve will open and treatment of the region 24' would recommence.

Without the check valve 38', the reversed flow 92' together with its sand content, would continue to flow into the injector 20' and be drawn into the string 14 under own pressure and by the drawing effect of the flow 94 of injection fluids down the base pipe 30. In such event, various components of the string 14, in particular, the screens and flow restriction devices, are exposed to the abrasive effects of passing sand and sand may accumulate at various locations along the string.

Similarly, a flow perturbation may occur during the operation of the injection string 14 within the base pipe 30, such as a water hammer event or a pressure surge during a shut-in of the well 10, that may initiate a flow reversal 92. Upon such event, one or more of the check valves 38, 38', 38" closes to prevent the flow reversal 92 from drawing sand-bearing formation fluids into the respective injectors 20, 20', 20" and the other portions of the injection string 14.

The above teachings provide apparatus, systems and methods that address the aforementioned issues with prior injection techniques, such as the deleterious effect of a flow reversal into a completion and the damage it may do to the proper functioning of an ICD. The embodiments provided herein address those issues by integrating a flapper type injection valve 38 downstream of a flow restriction device 34 within a housing to promote injection optimization. The valve 38 automatically closes tubing in a check valve component when the injection flow suffers a reversal. It also may include an element (its channel 53 and/or the orifice 72 of a supplemental ring 70) which maintains flow conformance control during injection in the same manner as the nozzle 34. The one-way check valve 38 blocks fluid passage during crossflow and backflow or any other cause of flow reversal, and may provide a back-up assurance (redundancy) to the flow controlling restriction through the nozzle 34. The arrangement effectively blocks fines production in the tubing and prevents injection performance degradation over the long term, where frequent shut-ins and cross flow due to pressure differentials amongst different sands are inevitable.

The above teachings are also applicable to the production of a hydrocarbon-bearing fluid from the formation of the reservoir 18, except that in the context of production, hydrocarbon-bearing fluid would flow through the system 14 in a direction opposite from that of an injection flow as previously described, and the check valve would operate in a directionally opposite manner. Accordingly, during production, the hydrocarbon-bearing fluid would normally flow from the formation, through the screen 35 and into the housing body 32 through the check valve 38, which would be operative to allow the fluid to flow in a first axial direction from the screen space 39 into the housing channel 37 and to close fluid flow responsive to perturbations in fluid flow tending to redirect fluid flow in a direction opposite of the first axial direction.

In a production embodiment, formation fluids flow into the screen space 39, then through the check valve 38 and the flow restriction devices 34 before entering the base pipe 30 through the ports 36. Accordingly, the check valve 38 is not directly communicated with nor exposed directly to the fluid flow within the base pipe 30 during production. Instead, the check valve 38 is located remotely from the fluid flowing through the base pipe 30. In embodiments, a nozzle ring 40 may be interposed between the check valve 38 and the ports 36, which arrangement further isolates and protects the check valve 38 from the fluid flow passing collectively through the base pipe 30.

In another production embodiment, it may be preferred to reverse the positions of the check valve 38 and the flow restriction devices 34 such that during production, formation fluids flow into the screen space 39, then through the nozzles and/or other flow restriction devices 34 before passing through the check valve 38 and entering the base pipe 30 through the ports 36.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What we claim:

1. A wellbore injection apparatus resistive to perturbations in fluid flows comprising:

a base pipe including a radial port at a location along the base pipe;

an in-flow control device comprising a flow restriction device and a housing, the housing external and concentric of the base pipe, the housing comprising a closed end portion adjacent the radial port, an open, opposite end portion distal from the base pipe port and a housing channel communicating the radial port with the opposite end portion;

the flow restriction device disposed at an intermediate location along the housing channel by a concentric support positioned within the housing channel and adapted to control a rate of flow along the housing channel;

a fluid transmissive screen concentric of the base pipe and extending from the open, opposite end portion of the housing, the screen and adjacent portions of the base pipe at least partially defining a screened space; and a check valve assembly disposed at an intermediate location along the housing channel distinct from the disposition of the flow restriction device and the check valve assembly disposed by a concentric support positioned within the housing channel and the check valve assembly adapted to control a direction of flow along the housing channel, the check valve assembly operative to allow fluid to flow in a first axial direction from the port, through the housing channel and into the screened space and to close fluid flow responsive to differential pressure across the valve assembly created by perturbations in fluid flow tending to redirect fluid flow through the valve in a direction opposite of the first axial direction.

2. The wellbore apparatus of claim 1, wherein the check valve assembly is biased to close responsively to a reversal of fluid flow in at least one of the screened space and the housing channel.

3. The wellbore apparatus of claim 2, wherein the check valve assembly is biased to close responsively to a reversal of fluid flow in the screened space due to at least one of a back flow and a cross flow adjacent the screen.

4. The wellbore apparatus of claim 2, wherein the check valve assembly is biased to close responsively to a reversal of fluid flow due to at least one of a water hammer event and a pressure surge.

5. The wellbore apparatus of claim 2, wherein the check valve assembly comprises a flapper valve.

6. The wellbore apparatus of claim 5, wherein the flapper valve comprises a biased flap body and an annular seat.

7. The wellbore apparatus of claim 2, wherein the check valve assembly comprises an annular valve comprising an annular seat concentric of the base pipe and a moveable annulus.

8. The wellbore apparatus of claim 2, wherein the flow restriction device is sized to impart a predetermined flow rate along the housing channel and the check valve assembly is configured to impart approximately the same predetermined flow rate.

9. The wellbore apparatus of claim 8, wherein the radial port is sized to permit a greater fluid flow than the flow restriction device and the check valve assembly.

10. The wellbore apparatus of claim 8, wherein the check valve assembly comprises a first ring provided with a check valve and a second ring provided with a flow-controlling, axially directed passage sized to impart approximately the same predetermined flow rate as the flow restriction device.

11. The wellbore apparatus of claim 2, wherein the flow restriction device and the check valve assembly comprise first and second axially directed flow passages, respectively.

12. The wellbore apparatus of claim 11, wherein the first and second axially directed flow passages are circumferentially offset from one another.

13. A method of extending a useful life of a well bore apparatus comprising an in-flow control device and a screen, the method comprising:

interposing a check valve assembly between the in-flow control device and the screen;

operating the check valve assembly disposed at an intermediate location along a housing channel distinct from a disposition of a flow restriction device and the check valve assembly disposed by a concentric support positioned within the housing channel and the check valve assembly adapted to control a direction of flow along the housing channel, to allow fluid to flow in a first axial direction relative to the screen and the in-flow control device and to close axial fluid flow responsive to differential pressure across the valve assembly created by perturbations in fluid flow tending to redirect fluid flow through the check valve assembly in a direction opposite of the first axial direction; and limiting flow rate to the screen redundantly with both the check valve assembly and a flow restriction device of the in-flow control device.

14. The method of claim 13, wherein the operating includes biasing the check valve assembly to close responsively to a reversal of fluid flow from a flow perturbation occurring adjacent at least one of the screen and the in-flow control device.

15. The method of claim 14, wherein the operating includes biasing the check valve assembly to close responsively to the reversal of fluid flow adjacent the screen due to at least one of a back flow and a cross flow.

16. The method of claim 14, wherein the operating includes biasing the check valve assembly to close responsively to the reversal of fluid flow adjacent the in-flow control device from a flow perturbation comprising at least one of a water hammer event and a pressure surge.

17. The method of claim 16, wherein the check valve assembly comprises a flapper valve.

18. The method of claim 17, wherein the flapper valve comprises a biased flap body and an annular seat.

19. The method of claim 14, wherein the check valve assembly comprises an annular valve comprising an annular seat and a moveable annulus.

20. The method of claim 14, wherein the limiting flow includes sizing the flow restriction device to impart a predetermined flow rate along the in-flow control device and configuring the check valve assembly to impart approximately the same predetermined flow rate.

21. The method of claim 14, further comprising communicating fluid from a base pipe into the in-flow control device through a port sized to permit a greater fluid flow than the flow restriction device and the check valve assembly.

22. The method of claim 14, wherein the flow restriction device and the check valve assembly comprise first and second axially directed flow passages, respectively, and the first and second axially directed flow passages are circumferentially offset from each other.

23. A method of stimulating a well bore comprising:

discharging a fluid from an in-flow control device through a screen while interposing a check valve assembly between the in-flow control device and the screen; and operating the check valve assembly disposed at an intermediate location along a housing channel distinct from a disposition of a flow restriction device and the check valve assembly disposed by a concentric support positioned within the housing channel and the check valve assembly adapted to control a direction of flow along the housing channel, to allow the fluid to flow in a first axial direction to the screen through the in-flow control device and to close fluid flow responsive to differential pressure across the valve assembly created by perturbations in fluid flow tending to redirect fluid flow through the check valve assembly in a direction opposite of the first axial direction.

24. The method of claim 23, further comprising limiting a flow rate to the screen redundantly with both the check valve assembly and a flow restriction device of the in-flow control device.

25. A system for producing hydrocarbons comprising:

a base pipe including a radial port at a location along the base pipe;

an in-flow control device comprising a flow restriction device and a housing, the housing external and concentric of the base pipe, the housing comprising: a closed end portion adjacent the radial port, an open, opposite end portion distal from the port and a housing channel communicating the radial port with the opposite end portion;

the flow restriction device disposed at an intermediate location along the housing channel and adapted to control a rate of flow along the housing channel;

a fluid transmissive screen concentric of the base pipe and extending from the open, opposite end portion of the housing, the screen and adjacent portions of the base pipe at least partially defining a screened space; and a check valve assembly disposed at an intermediate location along the housing channel distinct from the disposition of the flow restriction device and the check valve assembly disposed by a concentric support positioned within the housing channel and the check valve assembly adapted to control a direction of flow along the housing channel, the check valve assembly operative to allow fluid to flow in a first axial direction from the port, through the housing channel and into the screened space and to close fluid flow responsive to differential pressure across the valve assembly created by perturbations in fluid flow tending to redirect fluid flow through the valve in a direction opposite of the first axial direction.

26. The system of claim 25, wherein the check valve assembly is not in direct communication with a fluid flow within the base pipe during production.

27. The system of claim 25, wherein the flow restriction device is provided on a ring located between the check valve and the radial port, whereby the ring protects the check valve from a fluid flow within the base pipe during production.

28. A method of producing hydrocarbons from a formation of a well comprising:

drawing a hydrocarbon-bearing fluid from the formation into a screened space and into an in-flow control device while interposing a check valve assembly disposed at an intermediate location along a housing channel distinct from a disposition of a flow restriction device and the check valve assembly disposed by a concentric support positioned within the housing channel and the check valve assembly adapted to control a direction of flow along the housing channel, the check valve assembly operative to allow fluid to flow in a first axial direction from the port, through the housing channel and into the screened space and to close fluid flow responsive to differential pressure across the valve assembly created by perturbations in fluid flow tending to redirect fluid flow through the valve in a direction opposite of the first axial direction; and operating the check valve assembly to allow fluid to flow in a first axial direction into the in-flow control device from the screened space and to close fluid flow responsive to differential pressure across the valve assembly created by perturbations in fluid flow tending to redirect fluid flow through the check valve assembly in a direction opposite of the first axial direction.

29. The method of claim 28, further comprising limiting a flow rate from the screened space redundantly with both the check valve assembly and a flow restriction device of the in-flow control device.

30. The method of claim 28 further comprising: maintaining the check valve away from direct communication with a fluid flow within a base pipe during production.

31. The method of claim 28 wherein the flow restriction device comprises a nozzle, and further comprising: protecting the check valve from a fluid flow within a base pipe during production with a nozzle ring.

* * * * *